United States Patent [19]

Kleber et al.

[11] 4,177,231

[45] Dec. 4, 1979

[54] PROCESS FOR IMPROVING THE SLIDING PROPERTIES OF LINEAR POLYESTER MATERIAL IN SPINNING OPERATIONS

[75] Inventors: Rolf Kleber, Neu-Isenburg; Ulrich Cuntze, Hofheim am Taunus, both of Fed. Rep. of Germany

[73] Assignee: Hoechst Aktiengesellschaft, Fed. Rep. of Germany

[21] Appl. No.: 884,363

[22] Filed: Mar. 7, 1978

[30] Foreign Application Priority Data

Mar. 11, 1977 [DE] Fed. Rep. of Germany ..... 2710640

[51] Int. Cl.[2] ..... B29H 21/04

[52] U.S. Cl. ..... 264/130; 428/378; 428/395

[58] Field of Search ..... 28/178; 427/172; 264/136, 130, 210 Z, 290 T

[56] References Cited

U.S. PATENT DOCUMENTS

| | | | |
|---|---|---|---|
| 3,850,658 | 11/1974 | Gomez et al. | 57/157 S |
| 3,859,122 | 1/1975 | Burks et al. | 264/136 |
| 3,940,544 | 2/1976 | Marshall et al. | 428/395 |
| 3,973,386 | 8/1976 | Gorrafa | 264/136 |
| 4,043,010 | 8/1977 | Gorrafa | 264/136 |
| 4,054,634 | 10/1977 | Marshall et al. | 264/210 Z |
| 4,070,432 | 1/1978 | Tamaddon | 264/210 Z |

FOREIGN PATENT DOCUMENTS

| | | | |
|---|---|---|---|
| 1815361 | 6/1970 | Fed. Rep. of Germany | 264/210 Z |
| 2056695 | 5/1972 | Fed. Rep. of Germany | 264/210 Z |
| 51-32825 | 3/1976 | Japan | 264/210 Z |

*Primary Examiner*—Jay H. Woo

*Attorney, Agent, or Firm*—Connolly and Hutz

[57] ABSTRACT

Process for improving the sliding properties of linear polyester material in spinning operations, which comprises treating this material after the drawing with a mixture of the following components:

(a) 50 to 90% by weight of a condensation product of formula I $$R_1-\underset{\underset{O}{\|}}{C}-O-(C_2H_4O)_x-(C_3H_6O)_y-(C_2H_4O)_z-H \qquad (I)$$

in which $R_1$ is $C_{10}$–$C_{22}$alkyl or alkenyl, y is a number of from 20 to 40, and x plus z have a weight of less than 20% by weight of the polypropylene oxide portion, and (b) 50 to 10% by weight of a compound of formulae II and/or III $$R_2-\underset{\underset{O}{\|}}{C}-O-(C_2H_4O)_x-H \qquad (II)$$

and/or $$R_3-O-(C_2H_4O)_y-H \qquad (III)$$

in which $R_2$ and $R_3$ are $C_8$–$C_{18}$alkyl or alkenyl, and x and/or y are numbers of from 5 to 20.

2 Claims, No Drawings

PROCESS FOR IMPROVING THE SLIDING PROPERTIES OF LINEAR POLYESTER MATERIAL IN SPINNING OPERATIONS

The present invention relates to a process for improving the sliding properties of linear polyester material in spinning operations.

In the preparation of synthetic high-molecular-weight linear polyesters from dicarboxylic acids and polyhydric alcohols, for example from terephthalic acid-dimethylester and ethylene glycol, there are formed besides the desired long-chain macromolecules also short-chain reaction products in a small amount. These compounds, which are termed oligomers and which may be contained in an amount of up to 3% in the macromolecules of polyester fibers, are highly inconvenient in the further processing. Since the oligomer constituents cannot be dyed in the common dispersion dyeings, they become apparent after the dyeing as a white haze, for example, on dyed cross-wound bobbins. In rewinding and processing operations, this results in white dust deposits on thread guiding organs and the soiling of drawing units. Also, the oligomers being present in the dye bath are eliminated again and form a deposit in the dyeing units and on the fiber (P. Senner, Lenzinger Berichte, Dec. 1972, pages 44–51). Thus, the oligomer deposits lead to difficulties in processing, such as increasing thread tension, running and winding difficulties, as well as rubbing, which may well represent the difficulty that is most frequently found.

In order to avoid these difficulties, the following suggestions have been made (loc.cit.p. 46); to use an appropriate auxiliary agent of unknown constitution which disperses the oligomers during dyeing, and to discharge the dye bath as hot as possible.

In order to eliminate and disperse the oligomers in the course of the dyeing process, and also after the dyeing process in the subsequent rinsing baths, auxiliary agents have already been used. Thus, German Offenlegungsschrift No. 18 15 361 describes the treatment of linear polyesters with derivatives of copolymers of propylene oxide with ethylene oxide. The treatment is effected, for example, in the dyeing process. German Auslegeschrift No. 20 56 695 described the treatment of linear polyesters prior to drawing, i.e. in the course of their preparation, with diesters of butane diol-polyglycol ethers.

Conditioning agents of this kind, which are already used by the producer, can only help to influence the amount of oligomers in the preparation process. However, as these conditioning agents are washed off in the course of dyeing, it is necessary to apply additionally an oligomer-reducing auxiliary in the dyeing process or in the rinsing bath.

However, these known auxiliary agents show an insufficient activity towards oligomers in PES-POY filaments, i.e. in the preparation of previously orientated yarns with a winding rate of up to 3500 m/min., which show an increased oligomer portion. Furthermore, it has not yet been achieved to favorably influence the sliding properties of the PES fiber materials with these known products. It has therefore happened that PES fibers treated in this manner indeed showed only few oligomers in the further processing, however, due to the unfavorable influence of the feel and the rubbing properties by the auxiliaries used, the further treatment as rewinding and drawing units was adversely affected by the polymer abrasion itself and by the resulting breakages of the thread.

It has been tried to solve these problems of inadequate friction values of the PES materials by using—in combination with the oligomer-preventing auxiliaries—also additives which have a softening and smoothing effect on the fiber (Example 2 of German Offenlegungsschrift No. 2 056 695).

It has now been found that PES fiber materials can be treated in the further processing in a manner such that the inconvenient oligomers are eliminated and the smoothness and suppleness required for further treatment are achieved, so that there is no abrasion of oligomers and no resulting thread breakage in the processing. This objective is reached by treating the linear PES fiber materials with mixtures having the following composition:

(a) 50 to 90% by weight, preferably 60 to 80%, of a condensation product of the general formula I $$R_1-\underset{\underset{O}{\|}}{C}-O-(C_2H_4O)_x-(C_3H_6O)_y-(C_2H_4O)_z-H \qquad (I)$$

in which $R_1$ is $C_{10}$-$C_{22}$alkyl or alkenyl, preferably $C_{18}$, y is a number of from 20 to 40, preferably from 25 to 35 and x plus z are to be chosen in such a manner that the ethylene oxide portion altogether is less than 20% by weight of the polypropylene oxide portion, and (b) 50 to 10% by weight, preferably 40 to 20%, of a compound of formulae II and/or III $$R_2-\underset{\underset{O}{\|}}{C}-O-(CH_2CH_2O)_x-H \qquad (II)$$

$$\text{and/or} \quad R_3O-(C_2H_4O)_y-H \qquad (III)$$

in which $R_2$ and $R_3$ represent $C_8$–$C_{18}$alkyl or alkenyl, and x and/or y represent numbers of from 5 to 20.

Instead of the pure compounds of the above formulae there may also be used the mixtures thereof with different meanings of the individual radicals $R_1$, $R_2$ and $R_3$ in each case. In the same manner there may be used a mixture of the compounds II and III as component b).

The compounds of formulae I, II and III are known per se and may be obtained according to known methods by the addition of ethylene oxide and/or propylene oxide to fatty acids and fat alcohols. The above-described mixtures are either present as mixtures of the pure components, i.e. in this case the percentages by weight make up 100%, or the individual components together make less than 100% by weight. In the latter case the balance to 100% is water, and the components a) and b) are present in the form of aqueous solutions, emulsions or dispersions. In order to obtain the desired effect with the described mixtures, it is of decisive importance that a mixture of the fatty acid esters of polypropylene-ethylene oxide copolymers with oxethylated fatty acids and/or alcohols is used. The mixtures of the invention are applied in those processing steps of the PES fiber materials which follow the drawing operation. It is particularly advantageous to employ the products during or after the dyeing process, by which measure they prevent the oligomers from being deposited onto the dyeing bobbin or into the dye bath, and furthermore they impart the smoothness required for further processing to the fiber materials. The use of other additives is largely superfluous, the more so if the treatment is effected in the last rinsing bath before the drying.

The concentration is which the mixture is used in the treating baths is in the range of from 0.5 to 4 g of the components a) plus b) per liter, preferably from 1 to 3 g. The amount of active substance applied to the PES fiber after the treating process should be in the range of from about 0.05 to 0.5, preferably from 0.1 to 0.3% by weight of the components (a) plus (b).

It is a surprising fact which could not have been foreseen that this mixture of fatty acid esters of PPG-PEG copolymers and oxethylated fatty acids and/or fat alcohols effects the desired dispersion of oligomers and also imparts to the treated PES material the suppleness and smoothness necessary for further processing, as the individual components do not show this effect when employed separately.

The following Examples illustrate the invention.

EXAMPLE 1

A dyeing bobbin having a texturizing titer of PES (167 dtex f 32) is treated with the following bath (ratio 1:12):

1 g/l of auxiliary agent (characterized as follows)

3 g/l of $Na_2S_2O_4$ 10 ccm/l of NaOH 38° Bé for 30 minutes at 90° C., is then rinsed with water of 80° C. and dried at 110° C.

As PES material there is used a filament spun with 3300 m/min, which was textured by drawing to 167 dtex f 32.

Auxiliary agents (a) Coconut oil amine 0.5 parts of ethylene oxide (EO) as comparison (b) coconut propylene diamine 0.5 parts of EO as comparison (c) condensation product from 1,4-butanediol-decaglycol ether and 2 moles of lauric acid (Example 2, German Auslegeschrift No. 2 056 695 as comparison)

(d) oleic acid.10 (EO.PyO), EO:PyO being 9:1, as comparison (German Offenlegungsschrift No. 1 815 361)

(e) 70% stearic acid with PyO.EO (molar ratio 1.3:1), molecular weight of PPyO:1750; weight portion of EO: 10%, i.e. 4.4 moles of EO for 3 moles of PyO, 30% coconut oil acid.10 EO (f) 80% lauric acid PyO.EO (molar ratio 1:1) PPyO.EO as in (e) above 20% oleyl alcohol.5 EO (e) and f) are in accordance with the invention.

Following the reductive purification, and after the cold extraction with dioxan, the oligomer content was determined spectrophotometrically, and the following contents were measured on the fiber:

percent of oligoester

| | |
|---|---|
| a: 0.190 | d: 0.290 |
| b: 0.195 | e: 0.190 |
| c: 0.340 | f: 0.190 |

Blank value: 0.300 (reductive purification without auxiliary)

| Feel judgement | Abrasion Black filter test[1] | Rewinding behavior |
|---|---|---|
| a: hard | strong | thread breakages; polymer abrasion |
| b: hard | strong | thread breakages, polymer abrasion |
| c: soft | medium | moderate, abrasion (oligomers) |
| d: hard | strong | thread breakages, dust |
| e: soft | none | without objections |
| f: soft | none | without objections |
| blank value } hard | strong | thread breakages, dust |

The thread is guided in an alternating manner (width about 2 cm) tangentially at a rate of 200 m/min over a spool with glass paper (black filter), and after a running period of 30 minutes the abrasion is judged upon visual inspection.

In spite of their low content of oligoesters on the fiber, samples (a), (b) and (d) as comparison samples show abrasion as well as thread breakage. In the case of sample (c), which does have favorable sliding properties, an oligomer abrasion is nevertheless observed during rewinding; only the mixture of the invention shows the favorable sliding properties in the rewinding process which is important in practice.

EXAMPLE 2

A PES slubbing (3.6 dtex), which was dyed in the HT apparatus at a temperature of from 125° to 130° C. at a goods-to-liquor ratio of 1:12 with Disperse Yellow 5, C.I. No. 12 790, is treated upon discharging the dye bath with the following liquor, without intermediate rinsing:

2 g/l of auxiliary agent 2 g/l of hydrosulfite as a conc. powder 8 ccm/l of NaOH 38° Bé (of 32.5% strength)

The material is treated for 20 minutes at a temperature of from 85° to 90° C., then the bath is let off, and the goods are rinsed, while slowly cooling, until they are free from alkali.

Auxiliary agents (a) 60% Behenic acid with PyO.EO (molar ratio of 1.1:1), molecular weight of PyO: 2030; weight portion of EO: 15%, i.e. 7 moles of EO for 35 moles of PyO;

20% lauric acid.9 EO

20% tallow fat alcohol.15 EO (b) 90% palmitic acid with PyO.EO (molar ratio of 1.1:1), molecular weight of PyO: 1160; weight portion of EO: 8%, i.e. 2.1 moles of EO for 20 moles of PyO 10% oleyl alcohol.7 EO (c) without auxiliary, only purified by reduction.

In the further treatment of the slubbing, the portions treated according to the invention did not show any problems with regard to oligomer abrasion and fiber breakage, whereas the slubbing (c) purified by reduction without auxiliaries showed a strong abrasion.

What is claimed is:

1. Process for improving the sliding properties of linear polyester material in spinning operations, which comprises treating this material after the drawing with a mixture containing the following components:

(a) 50 to 90% by weight, preferably 60 to 80%, of a condensation product of the general formula I $$R_1-\underset{\underset{O}{\|}}{C}-O-(C_2H_4O)_x-(C_3H_6O)_y-(C_2H_4O)_z-H \quad (I)$$

in which $R_1$ is $C_{10}$–$C_{22}$ alkyl or alkenyl, preferably $C_{18}$, y is a number of from 20 to 40, preferably from 25 to 35 and x plus z have a weight of less than 20% by weight of the polypropylene oxide portion, and (b) 50 to 10% by weight, preferably 40 to 20%, of a compound of formulae II and/or III $$R_2-\underset{\underset{O}{\|}}{C}-O-(C_2H_4O)_x-H \quad (II)$$

and/or $$R_3-O-(C_2H_4O)_y-H \quad (III)$$

in which $R_2$ and $R_3$ are $C_8$–$C_{18}$alkyl or alkenyl, and x and/or y are numbers of from 5 to 20.

2. Process as claimed in claim 1, which comprises using the mixture of the following components:

70% stearic acid.PyO.EO; molecular weight of the PyO portion: 1750; weight portion of EO: 10%; 30% coconut oil acid.10 EO.

* * * * *